US009982533B2

(12) United States Patent
Bin Muhammad Moizuddin

(10) Patent No.: US 9,982,533 B2
(45) Date of Patent: May 29, 2018

(54) METHOD AND APPARATUS FOR GENERATING PULSES IN A FLUID COLUMN

(71) Applicant: Halliburton Energy Services, Inc, Houston, TX (US)

(72) Inventor: Muhammad Subhan Bin Muhammad Moizuddin, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days. days.

(21) Appl. No.: 15/521,747

(22) PCT Filed: Dec. 31, 2014

(86) PCT No.: PCT/US2014/072939

§ 371 (c)(1),
(2) Date: Apr. 25, 2017

(87) PCT Pub. No.: WO2016/108871

PCT Pub. Date: Jul. 7, 2016

(65) Prior Publication Data

US 2017/0292372 A1 Oct. 12, 2017

(51) Int. Cl.
*E21B 47/14* (2006.01)
*E21B 47/18* (2012.01)

(52) U.S. Cl.
CPC ..... *E21B 47/182* (2013.01); *E21B 47/18* (2013.01); *E21B 47/14* (2013.01); *E21B 47/185* (2013.01); *E21B 47/187* (2013.01)

(58) Field of Classification Search
CPC ..... E21B 47/14; E21B 47/18; E21B 47/182; E21B 47/185; E21B 47/187
See application file for complete search history.

(56) References Cited

U.S. PATENT DOCUMENTS 4,785,300 A * 11/1988 Chin ..... E21B 47/18 137/499
4,847,815 A 7/1989 Malone
5,357,483 A * 10/1994 Innes ..... E21B 47/18 367/84
5,586,083 A 12/1996 Chin et al.
(Continued)

OTHER PUBLICATIONS

International Search Report and the Written Opinion of the International Search Authority, or the Declaration, dated Sep. 21, 2015, PCT/US2014/072939, 16 pages, ISA/KR.

*Primary Examiner* — Hai Phan
*Assistant Examiner* — Franklin Balseca
(74) *Attorney, Agent, or Firm* — Haynes & Boone, LLP

(57) ABSTRACT

Methods and apparatus are disclosed for generating fluid pulses in a fluid column, such as within a well. Various described example fluid pulse generators each have a valve structure including a plurality of rollers rotatable around axes that are oriented perpendicular or otherwise angled with respect to the flow direction, the rollers being arranged to collectively at least partially obstruct the cross-sectional area of the fluid conduit. The rotational positions of the rollers may be varied to change the degree of obstruction in the conduit, thereby to generate pressure pulses in the fluid column detectable at a location remote from the fluid pulse generator; these pressure pulses can be used to encode a signal received at the fluid pulse generator.

20 Claims, 14 Drawing Sheets

(56) References Cited

U.S. PATENT DOCUMENTS

| | | | | |
|---|---|---|---|---|
| 5,636,178 | A * | 6/1997 | Ritter | E21B 47/18 367/83 |
| 5,740,126 | A | 4/1998 | Chin et al. | |
| 6,219,301 | B1 | 4/2001 | Moriarty | |
| 6,626,253 | B2 | 9/2003 | Hahn et al. | |
| 6,975,244 | B2 | 12/2005 | Hahn et al. | |
| 7,280,432 | B2 | 10/2007 | Hahn et al. | |
| 2010/0230113 | A1 | 9/2010 | Hutin et al. | |
| 2011/0011594 | A1 | 1/2011 | Young et al. | |
| 2014/0307527 | A1 | 10/2014 | Sitka | |

* cited by examiner

SECTION A-A
SCALE 1 : 1

Fig. 10A
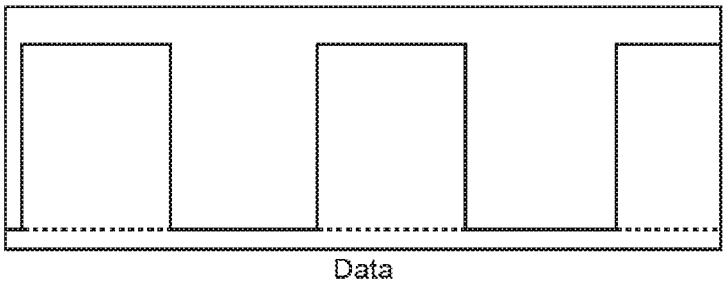
Fig. 10B
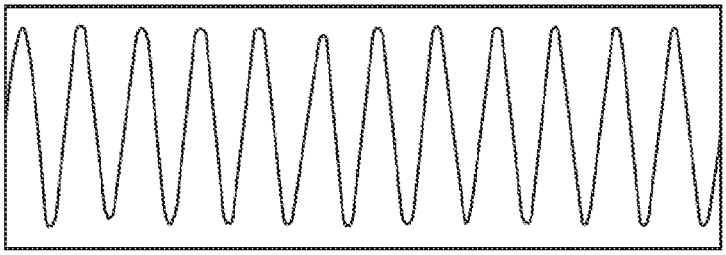
Fig. 10C
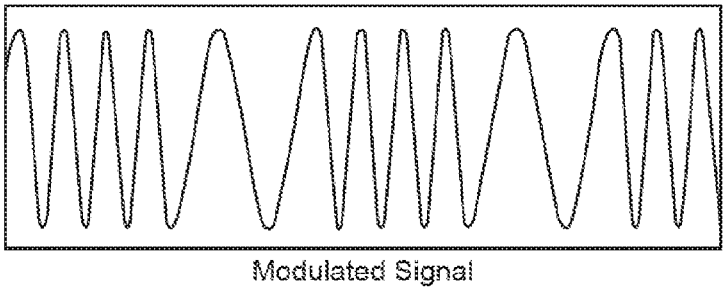
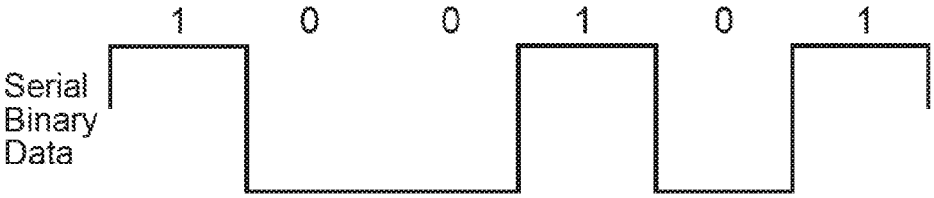
Fig. 11A
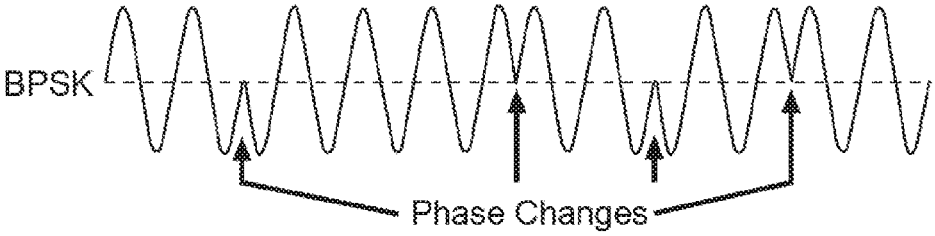
Fig. 11B

METHOD AND APPARATUS FOR GENERATING PULSES IN A FLUID COLUMN

PRIORITY

The present application is a U.S. National Stage patent application of International Patent Application No. PCT/US2014/072939, filed on Dec. 31, 2014, the benefit of which is claimed and the disclosure of which is incorporated herein by reference in its entirety.

BACKGROUND

This disclosure relates generally to methods and apparatus for generating pulses in a fluid column, as may be used for telemetry between a surface location and downhole instrumentation within a subterranean well.

Drilling fluid circulated down a drill string to lubricate the drill bit and remove cuttings is typically broadly referred to as drilling "mud." The generation of pulses in a drilling fluid column to communicate information to the surface is generally termed "mud pulse telemetry." Numerous mud pulse telemetry systems have been developed, using various forms of valve mechanisms, typically disposed in the drill string, to produce fluid pulses. Some mechanisms provide a bypass for the circulating fluid from the interior of the drill string to the wellbore annulus to create a controlled, momentary pressure drop or "negative pulse." Other mechanisms create a controlled restriction in the fluid path, causing a controlled, momentary pressure increase or "positive pulse." Such mechanism may utilize, for example, a "poppet" valve with a valve member that linearly reciprocates to open and close a fluid passageway.

An alternative approach to linear reciprocation is provided by the use of a rotary valve that can generate a continuously variable carrier wave onto which a signal is imparted by modulation. Apparatus implementing this approach are often referred to as "mud sirens." A rotary valve may include, for example, a rotor that rotates, relative to a stator, around an axis parallel to the fluid flow (rotating either reciprocally or continuously in the same direction) to periodically open and close one or more fluid passageways. Each of these systems offers various features and characteristics.

BRIEF DESCRIPTION OF THE DRAWINGS

FIGS. 10A-10C are graphs of a binary signal, a carrier wave, and a modulated wave encoding the signal, respectively, illustrating frequency-shift keying in accordance with one embodiment.

FIGS. 11A and 11B are graphs for a binary signal and a modulated wave encoding the signal, respectively, illustrating phase-shift keying in accordance with one embodiment.

DETAILED DESCRIPTION

Figure 1A:
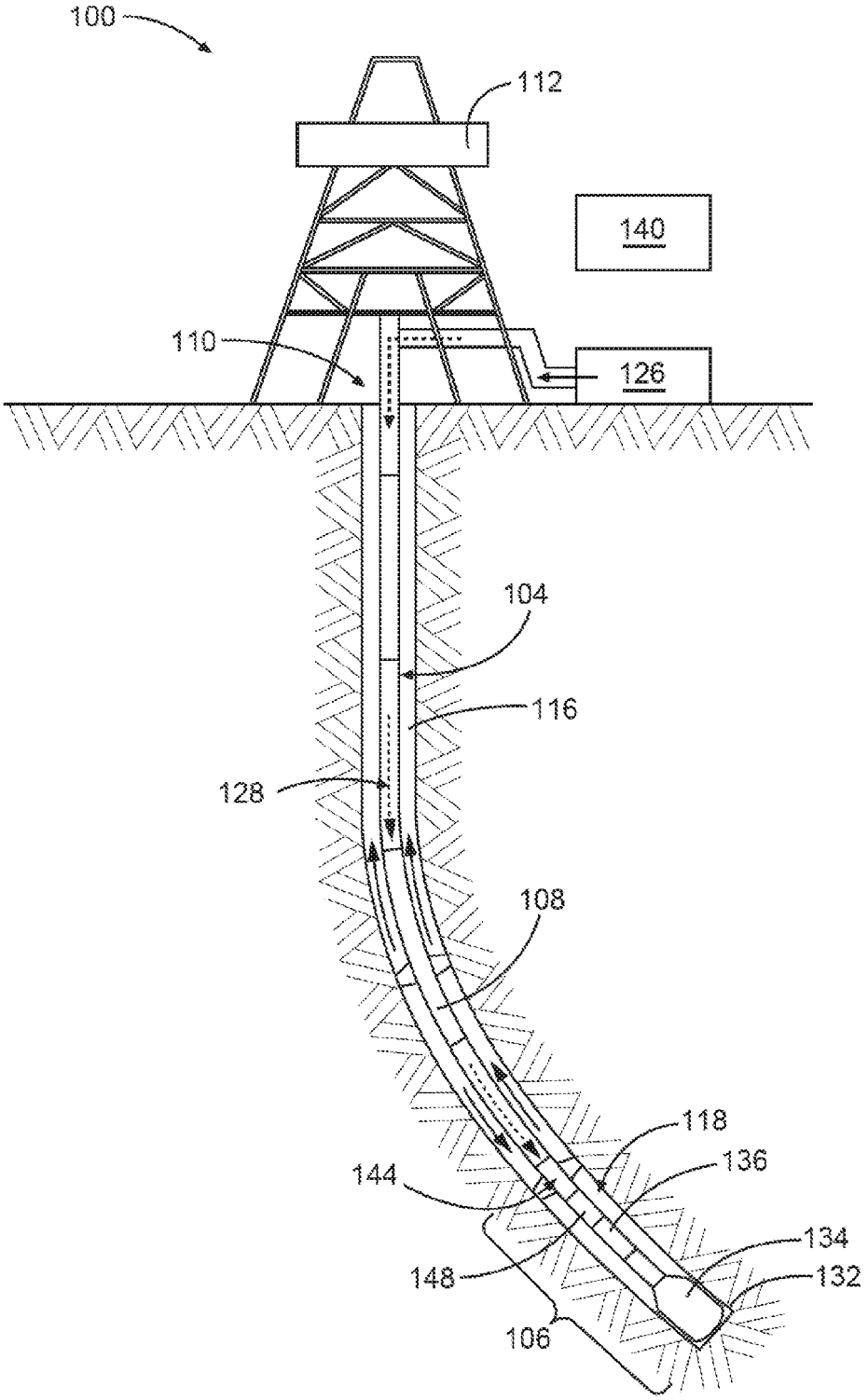
FIG. 1A is a schematic diagram of an exemplary tool string within a wellbore, the tool string including a mud pulse generator in accordance with the present disclosure.

The present disclosure includes new methods and apparatus for generating fluid pulse telemetry signals, wherein a plurality of rotating rollers, with axes of rotation oriented at a non-zero angle relative to the direction of fluid flow through a fluid conduit (and thus extending across at least a portion of the fluid conduit), collectively occlude at least a portion of the cross-sectional area of the conduit, the occluded portion varying with the rotational (or angular) position of the rollers. The term "roller," as used herein, refers to a member arranged to rotate about an axis (unidirectionally or bi-directionally, continuously or intermittently).

The rollers generally deviate in shape from cylindrical symmetry (i.e., each roller has a cross-section perpendicular to the respective roller's axis of rotation that is non-circular along at least a portion of the roller's length) such that the rollers define an open flow area through a transverse cross-section of the surrounding conduit, the open flow area varying as the rollers rotate. In various embodiments, the deviation from cylindrical symmetry may be achieved through different structures. In some embodiments, a roller may have a uniform, non-circular cross-section along its entire length. In other embodiments, a roller will include one or more recesses (or "carve-outs") extending inwardly from a lateral surface of an "envelope" of the roller, the envelope being the three-dimensional space occupied by the roller during a complete revolution around its axis. In the assembly of a plurality of rollers, the carve-outs provide fluid passageways (herein also referred to as "flow channels") that vary in size as each roller rotates, resulting in corresponding pressure fluctuations in the fluid. In some embodiments, the total area of the fluid passageways (as well as the total occluded area) depends sinusoidally on the rotational position of the rollers, facilitating the generation of a sinusoidal carrier wave by means of continuous rotation at constant speed.

The rollers may be rotated by a suitable drive mechanism, such as, for instance, a motorized gear drive, which may in turn be controlled based on a signal to be telemetered (e.g., a binary signal encoding down-hole measurements). For example, the rollers may continuously rotate to create a carrier wave, with the speed of rotation in the same direction being changed to encode the signal via frequency-shift keying, or the direction of rotation being changed to encode the signal via phase-shift keying. Alternatively, the rollers may repeatedly be rotated by a discrete angle and then halted, creating a series of discrete pressure pulses conveying the signal.

As will be apparent from the discussions herein, the rollers can be of a plurality of different shapes. In some embodiments used herein for illustration, the rollers are, but for their carve-outs, cylindrical in shape and are arranged with their axes of rotation (i.e., their longitudinal axes) parallel to each other in a transverse cross-sectional plane. In other embodiments, the rollers are conical in shape and arranged in the transverse plane in a radial fashion (i.e., with their longitudinal axes along the radii of the cross-section of the conduit). The envelopes of the rollers may abut one another such that the rollers collectively occlude substantially the entire conduit cross-section in at least one rotational position. Alternatively, gaps between the rollers may provide a minimum fluid passageway that is open regardless of the rotational position. The rollers may all rotate in the same direction, or adjacent rollers may rotate in opposite directions. In some embodiments, the speed of rotation is the same for all rollers.

The following detailed description describes example embodiments of the new mud pulse generator and associated methods with reference to the accompanying drawings, which depict various details of examples that show how the disclosure may be practiced. The discussion addresses various examples of novel methods, systems and apparatus in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

A mud pulse generator as described herein will be used to generate pulses in a fluid column within a downhole well to facilitate "mud pulse telemetry." This terminology embraces communication through pulses in a fluid column of any kind of well servicing fluid (or produced fluid) that may be in a well. One example of such use is for the mud pulse generator to be placed in a drill string along with measuring while drilling (MWD) (or logging while drilling (LWD)) tools, to communicate data from the MWD/LWD tools upwardly and to the surface through the fluid column flowing downwardly through the drill string to exit the drill bit. The pulses will be detected and decoded at the surface, thereby communicating data from tools or other sensors in the bottom hole assembly, or elsewhere in the drill string. The described example mud pulse generator relatively opens and closes fluid passages to create pulses in the fluid column of a selected duration and pattern which are detectable at the surface. In other contemplated systems, a mud pulse generator as described will be placed proximate the surface for providing downlink pulse communication to a downhole tool. Apart from facilitating telemetry in a borehole, fluid pulse generators in accordance herewith may also be used in other applications, e.g., as sound sources for underwater seismological explorations.

Referring now to FIG. 1A, the figure schematically depicts an example directional drilling system 100 configured to form wellbores at a variety of possible trajectories, including those that deviate from vertical. Directional drilling system 100 includes a land drilling rig 112 to which is attached a drill string, indicated generally at 104, with a bottom hole assembly, indicated generally at 106 (hereinafter BHA), in accordance with this disclosure. The present disclosure is not limited to land drilling rigs, and example systems according to this disclosure may also be employed in drilling systems associated with offshore platforms, semi-submersible, drill ships, and any other drilling system satisfactory for forming a wellbore extending through one or more downhole formations. Drilling rig 112 and associated surface control and processing system 140 can be located proximate the well head 110 at the Earth's surface. Drilling rig 112 can also include a rotary table and rotary drive motor (not specifically depicted), and other equipment associated with rotation or other movement of drill string 104 within wellbore 116. Other components for drilling and/or managing the well, such as blow out preventers (not expressly shown), may also be provided proximate well head 110. An annulus 118 is formed between the exterior of drill string 104 and the formation surfaces defining wellbore 116.

One or more pumps may be provided to pump drilling fluid, indicated generally at 128, from a fluid reservoir 126 at the upper end of drill string 104 extending from well head 110 through the BHA 106. Return drilling fluid, formation cuttings, and/or downhole debris from the bottom end 132 of wellbore 116 will return through the annulus 118 through various conduits and/or other devices to fluid reservoir 126. Various types of pipes, tubing, and/or other conduits may be used to form the complete fluid paths.

BHA 106 at the lower end of drill string 104 terminates in a drill bit 134. Drill bit 134 includes one or more fluid flow passageways with respective nozzles disposed therein. Various types of well fluids can be pumped from reservoir 126 to the end of drill string 104 extending from wellhead 110. The well fluid(s) flow through a longitudinal bore (not expressly shown) in drill string 104, and exit from nozzles formed in drill bit 134. During drilling operations, drilling fluid will mix with formation cuttings and other downhole debris proximate drill bit 134. The drilling fluid will then flow upwardly through annulus 118 to return the formation cuttings and other downhole debris to the surface. Various types of screens, filters, and/or centrifuges (not expressly shown) will typically be provided to remove formation cuttings and other downhole debris prior to returning drilling fluid to reservoir 126.

Bottom hole assembly (BHA) 106 can include various components, for example one or more measurement while drilling (MWD) or logging while drilling (LWD) tools 136, 148 that provide logging data and other information to be communicated from the bottom of wellbore 116 to surface equipment 108. In this example string, BHA 106 includes mud pulse generator 144 to provide mud pulse telemetry of such data and/or other information through the fluid column within the drill string to a surface receiver location, for example, proximate the wellhead 110. Mud pulse generator 144 may be constructed in various ways, e.g., in accordance with any of the example embodiments described herein. In the example system herein, mud pulse generator will be in the form of a separate sub insertable into the drill string within in housing (see FIG. 1B). At the surface receiver location, the pressure pulses in the fluid column may be detected and converted to electrical signals for communication to other surface equipment, and potentially from there to other locations.

The communicated logging data and/or other information communicated to a receiver up-hole may be communicated to a data processing system 140. Data processing system 140 can include a variety of hardware, software, and combinations thereof, including, e.g., one or more programmable processors configured to execute instructions on and retrieve data from and store data on a memory to carry out one or more functions attributed to data processing system 140 in this disclosure. The processors employed to execute the functions of data processing system 140 may each include one or more processors, such as one or more microprocessors, digital signal processors (DSPs), application specific integrated circuits (ASICs), field programmable gate arrays (FPGAs), programmable logic circuitry, and the like, either alone or in any suitable combination.

For some applications, data processing system 140 may have an associated printer, display, and/or additional devices to facilitate monitoring of the drilling and logging operations. For many applications, outputs from the data processing system will be communicated to various components associated with operating drilling rig 112 and may also be communicated to various remote locations monitoring the performance of the operations performed through drilling system 100.

Figure 1B:
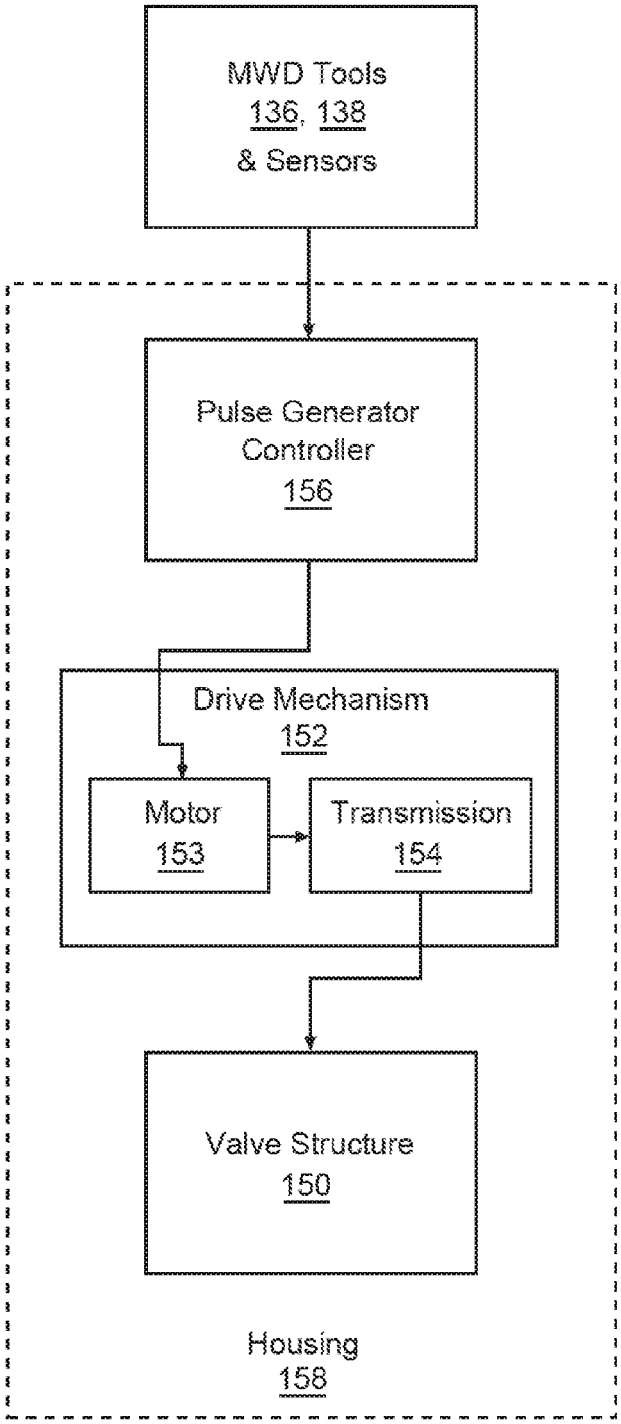
FIG. 1B is a block diagram of a mud pulse generator and associated measuring devices, illustrating various components of the mud pulse generator in accordance with one embodiment.

As shown in FIG. 1B, the mud pulse generator 144 may include a valve structure 150 for selectively occluding the fluid path through the drill string to one or more variable degrees, a drive mechanism 152 (including, e.g., a motor 153 and associated transmission system 154) with the valve structure, and a controller 156 that operates the drive mechanism 152 to communicate information or other signals through a fluid column to a remote location. Such information may include control signals or information signals. Such information signals can be of any type of information, and in many applications will include signals received from, e.g., the MWD tools 136, 148 or other sensors disposed within or at the BHA. For example, the controller 156 may receive a binary signal encoding the measured data (e.g., a downhole temperature, pressure, formation resistivity, etc.) as input, and control the valve structure to communicate the signals. Signal communication may be achieved by modulating a continuous carrier wave, or by generating a series of discrete pulses, as explained in more detail below. In some embodiments, the controller is integrated with control- and processing-circuitry of the tools 136, 148 or other sensors. The valve structure 150, and optionally also the drive mechanism 152 and/or controller 156 (or portions thereof) may be disposed in a housing 158 that is connected to other components, or systems in the BHA 106. The housing 158 defines a fluid conduit therethrough, allowing fluid flow generally in a direction along the longitudinal axis of the BHA.

Figure 1C:
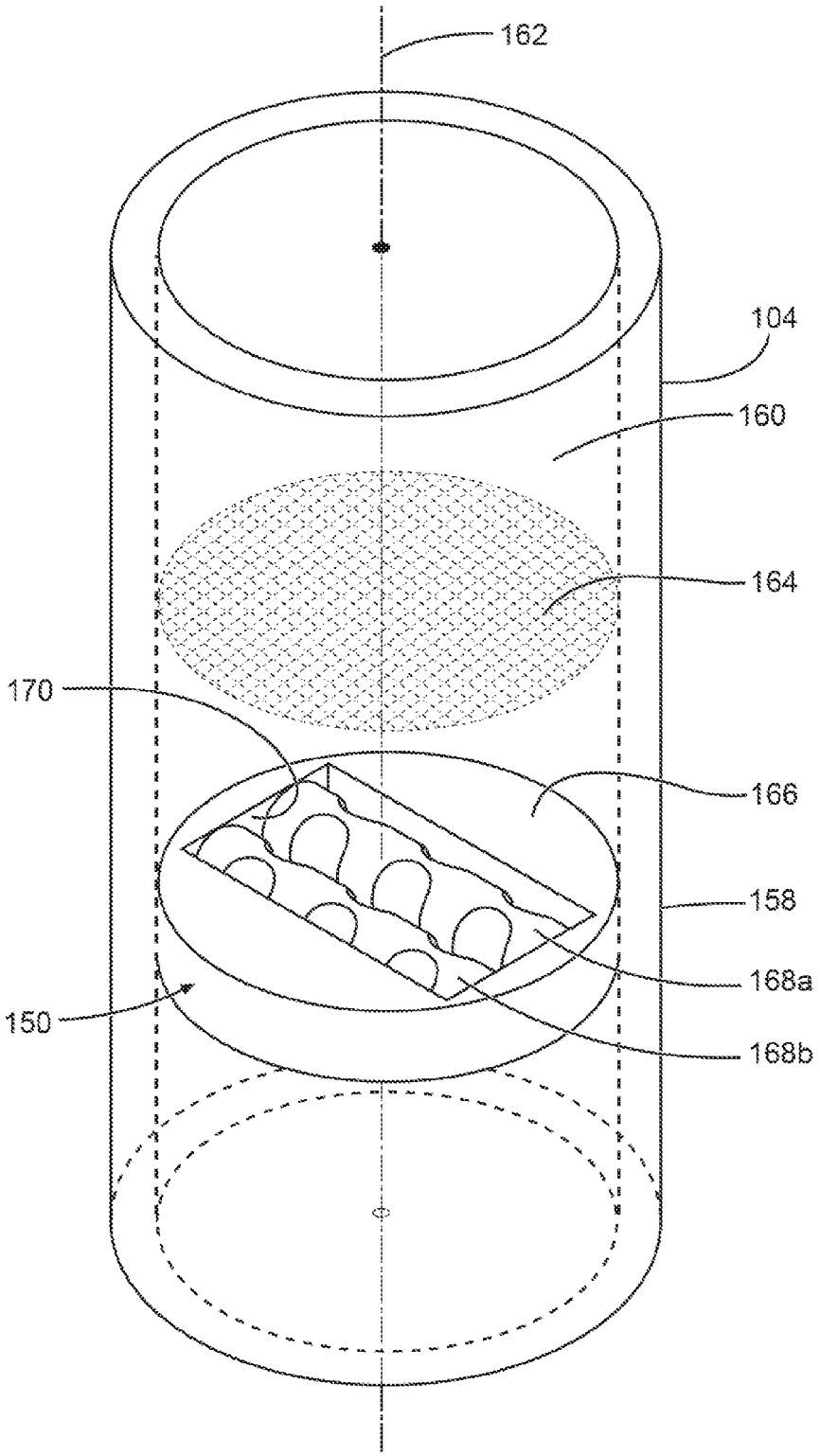
FIG. 1C is a perspective view of a valve structure in which a housing for the valve structure forms a portion of the drill string, in accordance with one example embodiment.

FIG. 1C is a perspective view of an example embodiment of a valve structure 150, in which a housing 158 for the valve structure forms a portion of the drill string 104. The interior of housing 158 defines a cylindrical fluid conduit 160 which communicates with the remainder of the flow conduit defined by the remainder of the drill string 104. A cross-section of that fluid conduit perpendicular to the longitudinal axis 162 is indicated with shading at 164. The two-dimensional area of the shaded cross-section 164 illustrates the cross-sectional area of the conduit 160. The depicted example valve structure 150 includes a disk-shaped support frame 166 fitted within and mounted to the interior wall of the housing 158. Two rollers 168*a*, 168*b* are mounted within an opening 170 through the support frame 166. Collectively, the rollers 168*a*, 168*b* and support frame 166 occlude at least a portion of the cross-sectional area 164 of the fluid conduit 160, with the degree of that occlusion varying as a function of the rotational position of rollers 168*a*, 168*b*.

Figure 2A:
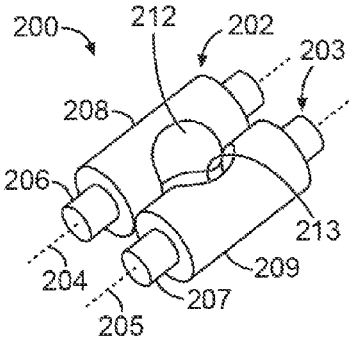
FIGS. 2A-L are, respectively, isometric views (FIGS. 2A, 2D, 2G, 2J), top views (FIGS. 2B, 2E, 2H, 2K), and cross-sectional side views (FIGS. 2C, 2F, 2I, 2L) of an example valve structure for use in generating fluid pulses, depicted in four rotational positions, illustrating the operating principle of the valve structure in accordance with one example embodiment. In this example embodiment, the two rollers of the valve structure rotate in opposite directions.
Figure 2B:
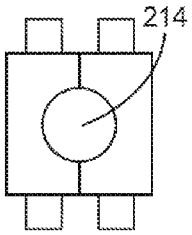
Figure 2C:
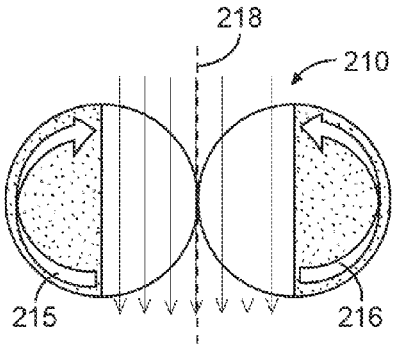
Figure 2D:
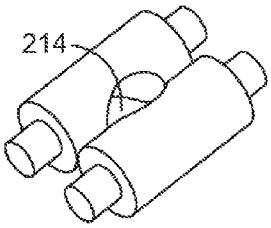
Figure 2E:
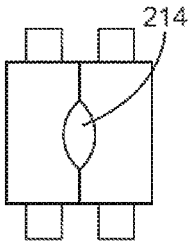
Figure 2F:
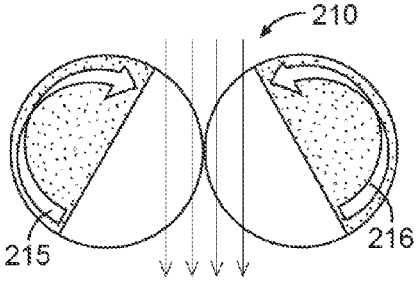
Figure 2G:
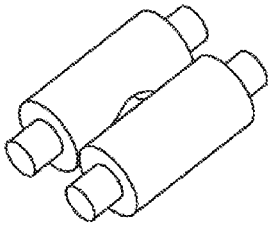
Figure 2H:
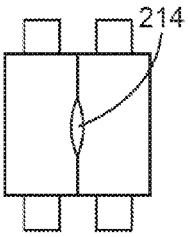

Referring now to FIGS. 2A-2L, the principle of operation of an example valve structure 200 including two cylindrical rollers 202, 203 is illustrated with isometric, top, and cross-sectional views for four rotational positions. The equally sized and shaped rollers 202, 203 are oriented and positioned with their rotational (or longitudinal) axes 204, 205 (i.e., the straight lines extending along (and beyond) the center lines of their physical axles 206, 207) in parallel and their cylindrical envelopes 208, 209 contacting one another. In use inside a fluid conduit (e.g., as defined by the housing containing the valve structure), the rollers may be arranged with their axes 204, 205 in a cross-section of the conduit, perpendicular to the direction of fluid flow through the conduit (indicated by the arrows 210 in FIGS. 2C, 2F, 2I, and 2L), such that the cylindrical envelopes obstruct the fluid path. Each roller 202, 203 includes a semi-cylindrical carve-out 212 or 213 defined around an axis tangential to the envelope 208 or 209 and perpendicular to the axis 204 or 205 of rotation. As the rollers 202, 203 rotate, these carve-outs 212, 213 rotate along with them. The carve-outs 212, 213 are aligned with each other in a direction along the longitudinal axes 204, 205 such that they form a single fluid passageway (or flow channel) 214 when facing each other, as best shown in FIGS. 2B, 2E, and 2H.

Figure 2I:
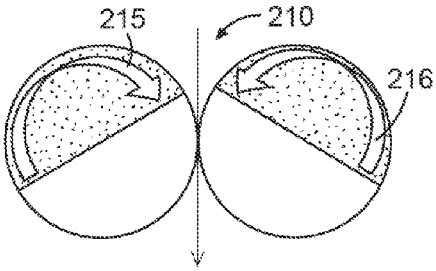
Figure 2J:
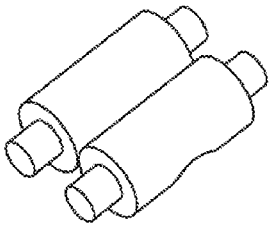
Figure 2K:
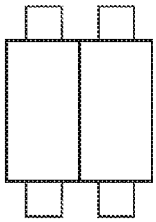
Figure 2L:
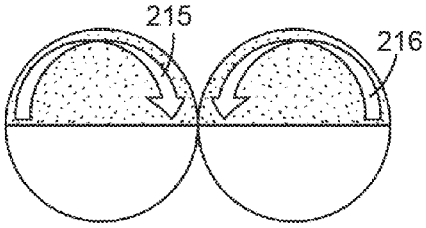

In the illustrated embodiment, the rollers rotate in opposite directions (indicated by the arrows 215, 216 in FIGS. 2C, 2F, 2I, and 2L) and in phase such that, in a first rotational position, depicted in FIGS. 2A-2C, the two semi-cylindrical carve-outs 212, 213 combine to form a full cylindrical carve-out (shown in the top view of FIG. 2B as a circle). The cross-section depicted in FIG. 2C is taken along the symmetry axis 218 of that cylindrical carve-out, perpendicularly to the rollers' longitudinal axes 204, 205. The rotational state shown in FIGS. 2A-2C corresponds to the fully open state of the valve structure 200. As the rollers 202, 203 rotate and thereby tilt the carve-outs 212, 213 relative to and move them away from each other, the flow channel 214 created between the rollers 202, 203 becomes smaller and smaller (see FIGS. 2D-2F, showing a second rotational position of about 30°, and FIGS. 2G-2I, showing a third rotational position of about (60°). After a 90° rotation of both rollers 202, 203 relative to the initial, fully open position, the valve 200 is fully closed (see FIGS. 2G-2I). A further rotation of both rollers by 90° results in the carve-outs facing away from each other; in this rotational position, two separate semi-cylindrical fluid passageways are created, collectively forming an opening of the same size as the initial, fully open state.

Figure 3:
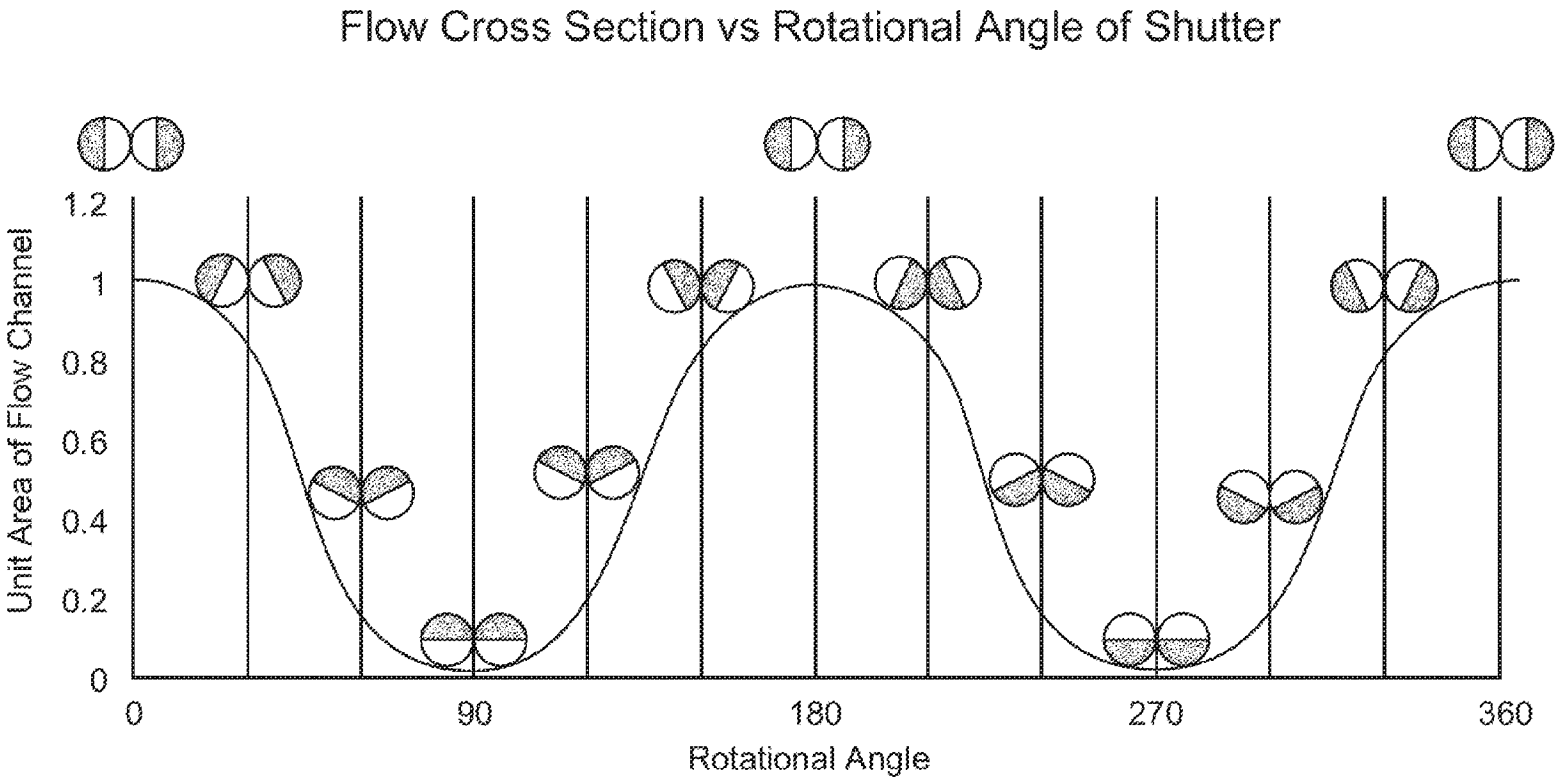
FIG. 3 is a graph of the area of the flow channel created by the valve structure depicted in FIGS. 2A-2L as a function of the rotational position, in accordance with one embodiment.

In FIG. 3, the cross-sectional area of the flow channel 214 (normalized to unit area 1 for the fully open valve) is plotted as a function of the rotational position (or rotational angle) for a full (i.e., 360°) cycle of rotation. Symbolic cross-sectional views of the rollers 202, 203 in the various rotational positions are depicted along the graph. As shown, the area of the flow channel 214 varies more or less sinusoidally ("quasi-sinusoidally") between maxima at 0° and 180° and minima at 90° and 270° (i.e., the flow channel area undergoes two full cycles during one cycle of rotation). The functional dependence of the flow-channel area on the angle may be a sine in the strict mathematical sense, or deviate somewhat from true sinusoidal behavior while still exhibiting certain qualitative features of a sine (such as, e.g., symmetry about and continuous derivatives at the local maxima and minima). The variable restriction on the fluid path creates a proportionately varying back pressure in the fluid column. The signal strength $S_{strength}$ generally relates to the flow area A according to $$S_{strength} \propto \frac{\rho Q^2}{A^2},$$

where ρ is the fluid density (e.g., the mud density) and Q is the flow rate. A benefit of the valve structure 200 compared with, e.g., a poppet valve, is that it does not work against the fluid flow, which may significantly reduce the power required to actuate the valve.

Figure 4A:
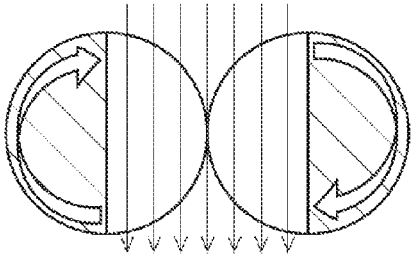
FIGS. 4A-4D are cross-sectional views of an example valve structure otherwise similar to the structure of FIGS. 2A-2D, but in an operational mode in which the two rollers rotate in the same direction, in accordance with one embodiment.
Figure 4B:
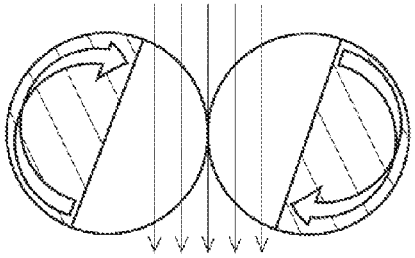
Figure 4C:
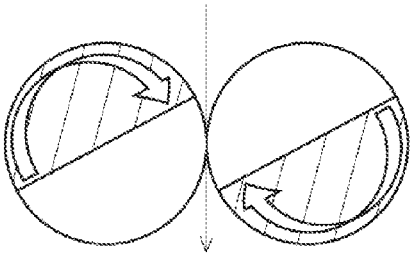
Figure 4D:
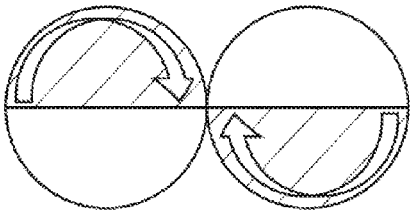

As will be readily apparent to those of ordinary skill in the art, various modifications of the valve structure 200 can be implemented while still employing the same operational principle as described above. For example, in a valve structure otherwise similar to that of FIGS. 2A-2L, the rollers 202, 203 may rotate in the same direction; FIGS. 4A-4D illustrate this mode of operation with cross-sectional views taken in four rotational positions between 0° (FIG. 4A and 90° (FIG. 4D). The resulting angular dependence of the flow channel area is the same as for roller rotation in opposite directions.

Figure 5A:
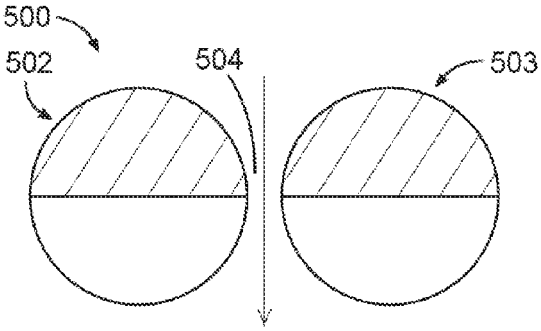
FIGS. 5A-5D are cross-sectional views of an example valve structure otherwise similar to the structure of FIGS. 2A-2D, but in which the rollers are spaced so as to not contact one another, in accordance with one embodiment.
Figure 5B:
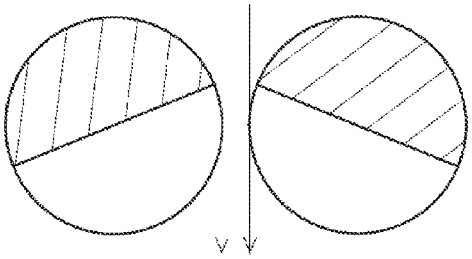
Figure 5C:
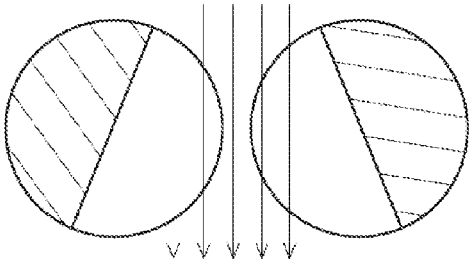
Figure 5D:
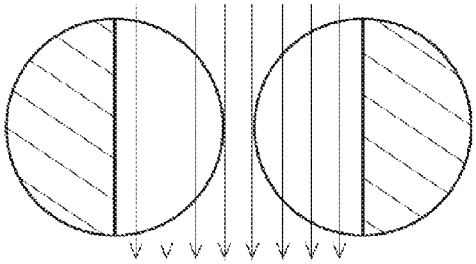

Another modification, illustrated in FIGS. 5A-5D, involves placing the rollers 502, 503 of the valve structure 500 at a greater center-to-center distance (relative to the roller diameter) from each other to create a permanent gap 504 between them. In this embodiment, fluid can flow through the valve structure 500 even when it is in the "fully closed" state, which is shown in FIG. 5A. The flow channel area varies in the same manner as depicted in FIG. 3, but with an offset equal to the minimal achievable area in this valve configuration (i.e., the flow channel area in the fully closed state), which is the area attributable to the gap 504. An advantage of this embodiment is that it never completely interrupts the flow of drilling fluid, and is therefore less susceptible to jamming by large particulates in the drilling fluid (which, in embodiments with contacting rollers, may be lodged in the interface region).

FIGS. 6A-6D illustrates more completely an example valve structure 600 operating in accordance with the principle depicted in FIGS. 2A-2L that spans the circular cross-section of a fluid conduit. The valve structure 600 includes four (more generally, a plurality of) cylindrical rollers 602, 603, 604, 605 arranged in parallel to each other across a suitably sized and shaped opening 610 of a disc-shaped support frame 612. The support frame 612 may be circular in shape, and may be sized to tightly fit inside the fluid conduit defined by the housing of the mud pulse generator, or form an integral part of the housing. In various embodiments, the support frame 612 is mounted to the interior wall of the drill collar of the BHA. The thickness of the disc-shaped support frame 612 may (but need not necessarily) be generally equal to the diameter of the rollers. The rollers 602, 603, 604, 605 may be mounted inside the support frame 612 via their axles, which may extend through openings 614 in the side wall 615 of the frame 612.

Figure 6A:
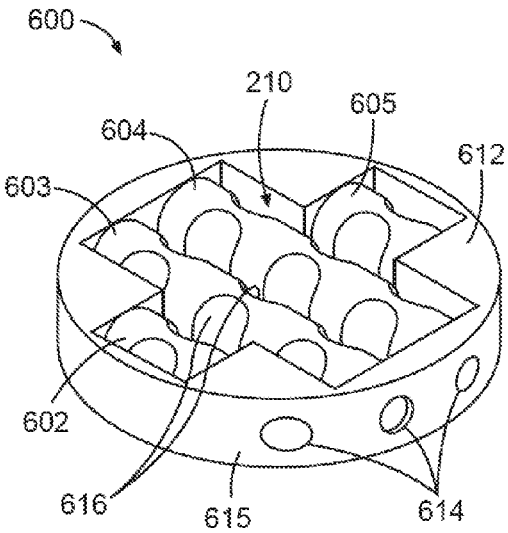
FIGS. 6A and 6B are perspective and top views, respectively, of an example valve structure including, in accordance with one embodiment, four cylindrical rollers in a parallel arrangement, depicted in its open state.
Figure 6B:
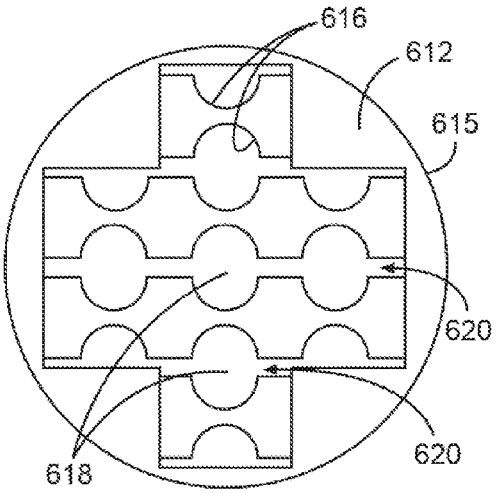
Figure 6C:
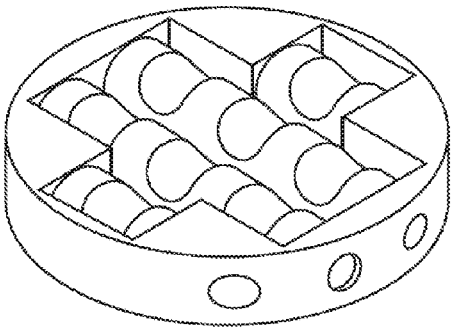
FIGS. 6C and 6D are perspective and top views, respectively, of the valve in its closed state.
Figure 6D:
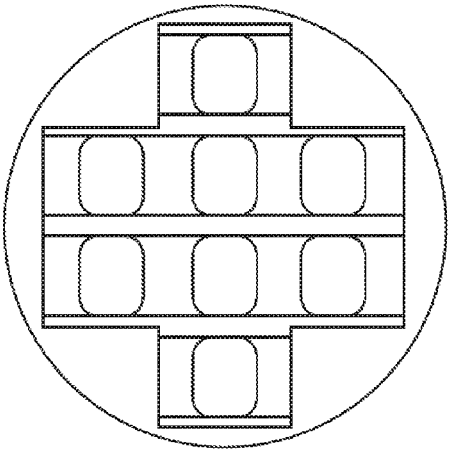

The rollers 602, 603, 604, 605 may differ in length to better accommodate the circular cross-section the structure 600 is designed to span, and may include multiple carve-outs at different positions along their longitudinal axes. Furthermore, some or all of the rollers may include pairs of carve-outs that intersect the envelope of the roller on opposite sides. In the embodiment shown, the valve structure 600 includes two shorter rollers 602, 605 flanking two adjacent longer rollers 603, 604. Each of the longer rollers 603, 604 includes three pairs of carve-outs 616, while each of the shorter rollers 602, 605 has only one pair of carve-outs 616. The carve-outs in adjacent pairs of rollers are longitudinally aligned (as explained above with respect to FIGS. 2A-2L) to form more or less cylindrical flow channels 618 through the valve 600 when the valve is fully open, as shown in FIGS. 6A and 6B. (In the illustrated embodiment, the flow-channel geometry deviates slightly from perfect cylindrical shape due to a small gap 620 between the rollers.) When the valve 600 is fully closed, as shown in FIGS. 6C and 6D, the carve-outs face upward/downward and do not contribute to the flow channel, which is then limited to the gaps 620 between the rollers.

Figure 7A:
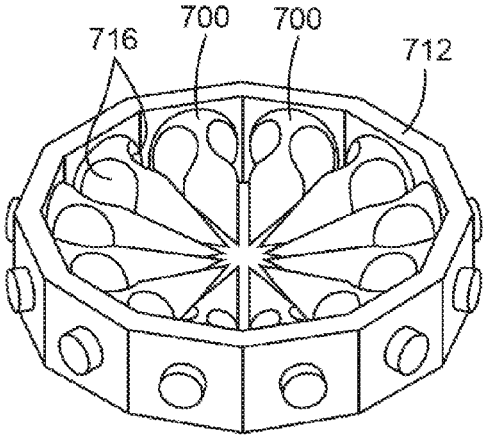
FIGS. 7A and 7B are perspective and top views, respectively, of an example valve structure including, in accordance with one embodiment, a plurality of conical rollers in a radial arrangement in its open state.
Figure 7B:
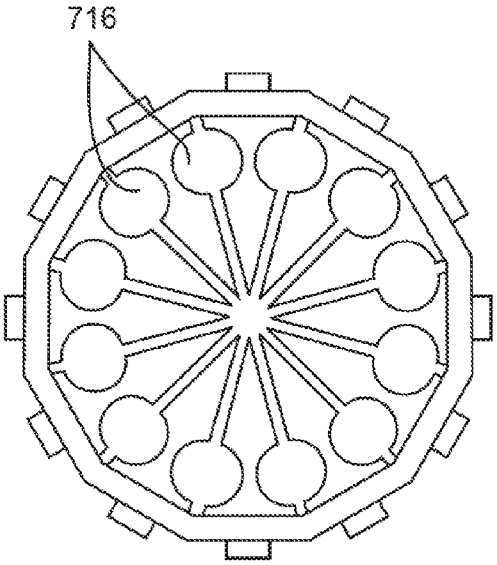
Figure 7C:
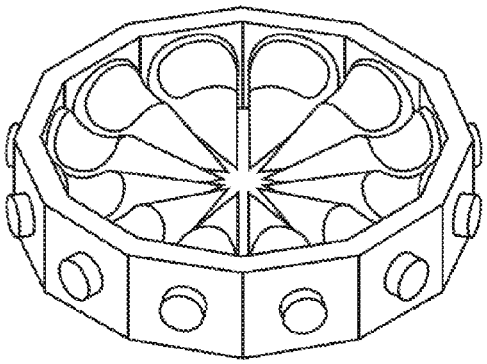
FIGS. 7C and 7D are perspective and top views, respectively, of the valve in its closed state.
Figure 7D:
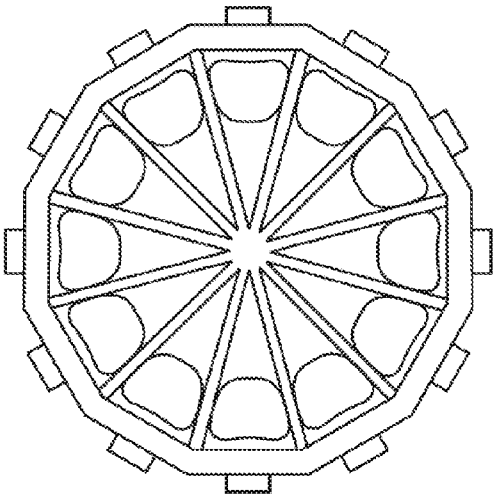

Embodiments hereof are not limited to cylindrical rollers oriented in parallel, but may incorporate alternative roller shapes and configurations. For example, as FIGS. 7A-7D show, the rollers 700 may have conical envelopes and may be arranged radially in a cross-section of the fluid conduct. The rollers may be mounted in a ring-shaped (e.g., circular or polygonal) support frame 712 (or, put differently, a disc-shaped support frame similar to the frame 612 holding the cylindrical rollers, but with a central carve-out suited to the radial arrangement of the rollers and therefore generally exhibiting a greater degree of radial symmetry). In the illustrated embodiment, each conical roller 700 includes a single pair of carve-outs 716; collectively, the carve-outs 716 are arranged along a circle around the center of the valve structure. FIGS. 7A and 7B illustrate the valve structure in the fully open configuration, and FIGS. 7C and 7D show it in the closed state. The operational principle is the same as that described above with respect to valve structures with cylindrical rollers. Of course, the depicted valve structure may be modified by including multiple pairs of carve-outs in each roller at different positions along the longitudinal axes of the cones; the entirety of carve-outs may then be arranged along multiple concentric circles, and the size of the carve-outs may be smaller for the inner one(s) of the concentric circles than for the outer one(s).

It is emphasized that the valve structures depicted herein are merely non-limiting examples, and that various modifications and alternative implementations employing the principles and concepts disclosed herein are possible. It will be readily apparent to those of ordinary skill in the art, for example, that a valve structure may include different numbers of rollers than illustrated herein. For instance, a valve structure similar to that of FIGS. 6A-6D may utilize, instead of four cylindrical rollers, fewer (e.g., two or three) or more (e.g., five, six, etc.) rollers in a parallel configuration. Similarly, the valve structure of FIGS. 7A-7D may use fewer or more than the depicted twelve conical rollers. Advantageously, the use of multiple rollers generally affords flexibility, for any given valve structure, to operate fewer or more of these rollers, provided that they are controllable individually (or in groups). Selectively operating sub-sets of rollers, in turn, facilitates controlling the strength (or amplitudes) of the pressure pulses generated by the rotation of the selected rollers as well as the average open flow-channel area through the valve. For example, in some circumstances, rotating half of the rollers may result in pressure pulses of sufficient signal strength; the remaining rollers may then be kept in their fully open states to limit the overall obstruction to fluid flow through the drill pipe.

Figure 8A:
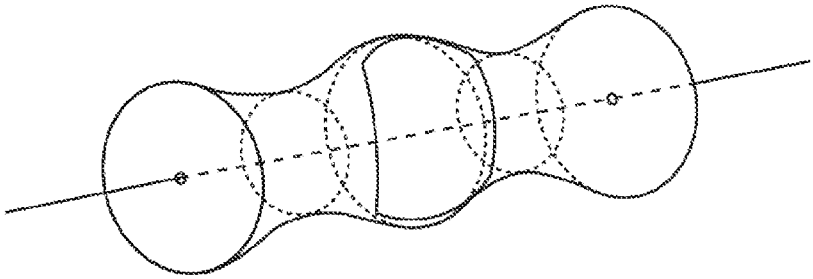
FIGS. 8A-8D are schematic perspective views of example roller geometries in accordance with various embodiments.
Figure 8B:
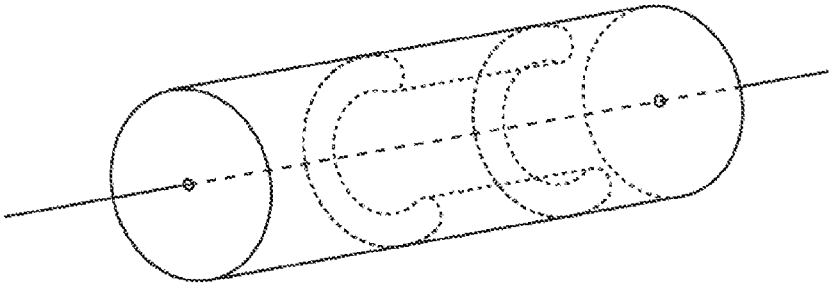
Figure 8C:
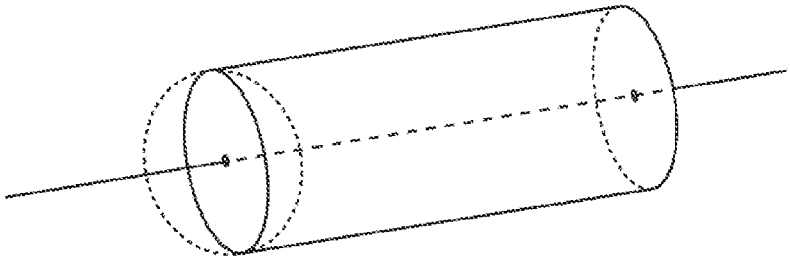
Figure 8D:
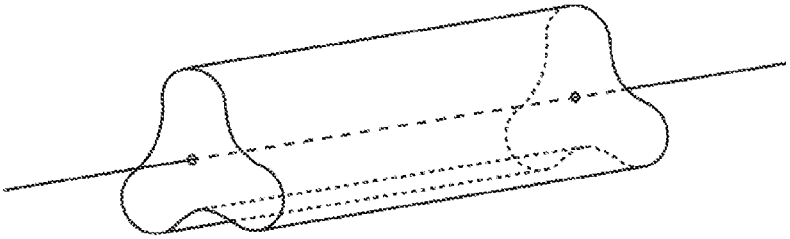

Furthermore, rollers having envelope shapes other than cylinders or cones may also be used. For example, the envelopes of the rollers need not be topologically flat (as are cylinder and cone envelopes), but may exhibit curvature; an example of a roller with a curved envelope is shown in FIG. 8A. (Topologically flat envelopes may be advantageous for embodiments in which a complete obstruction of the fluid path in the closed state of the valve is desired, as they facilitate contact between the envelopes of adjacent rollers along their entire length. However, the same effect can also be achieved if adjacent rollers are complementary in shape (e.g., a bulge is aligned with a recess in the adjacent roller).) The shape of the carve-outs themselves may also vary from that illustrated in the accompanying drawings. For instance, the carve-outs may extend beyond the center line of the roller, as illustrated in FIG. 8B, and the boundary surfaces of the carve-outs need not be cylindrical. Further, the rollers need not necessarily define distinct carve-outs at all, as long as their projections into the cross-section of the fluid conduit vary in size as the rotational position of the rollers changes and thereby cause varying flow-channel areas. This condition is generally met by a deviation of the rollers from cylindrical symmetry (or, in other words, a deviation of a roller cross-section perpendicular to the longitudinal axis from perfect circularity). For example, rollers with elliptical cross-sections, as shown in FIG. 8C, or with three-lobed cross-sections, as shown in FIG. 8D, will result in variable flow-channel areas.

In addition, the rollers need not necessarily be arranged in a plane perpendicular to the direction of fluid flow. For example, their longitudinal axes may be arranged on the lateral surface of a cone (along straight lines from the apex to the base) whose base coincides with the cross-section of the fluid conduit. While the embodiments depicted herein may be advantageous due, for example, to their comparative geometric simplicity, which may reduce the cost of design and manufacture, they are not intended to be limiting. In general, in accordance herewith, the rollers are "angled" relative to, i.e., enclose a non-zero angle with, the general direction of fluid flow through the conduit (and/or the longitudinal axis of the BHA). (The term "non-zero," in this context, is intended to mean a deliberate, significant deviation from zero degrees (e.g., in some embodiments, at least 10° or at least 30°), and is not to be read on a slight deviation from a perfect 0° angle due to manufacturing inaccuracies or other unintended causes.) In some embodiments, the longitudinal axes are "generally perpendicular" to the direction of fluid flow at the entrance to the valve structure (which is taken to be the region immediately preceding the rollers), wherein "generally perpendicular" is broadly understood to denote a range of angles of, in various embodiments, 90°±45°, 90°±30°, 90°±10°, 90°±5°, or 90°±2°, etc.

Figure 9A:
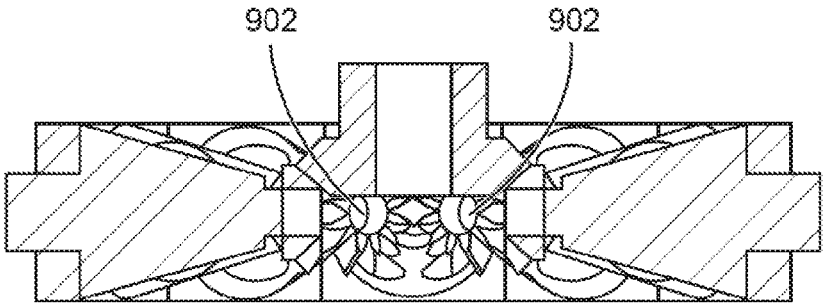
FIGS. 9A and 9B are a cross-sectional side view and a top view, respectively, of an example bevel gear drive mechanism for a valve structure with conical rollers in a radial arrangement, in accordance with one embodiment.
Figure 9B:
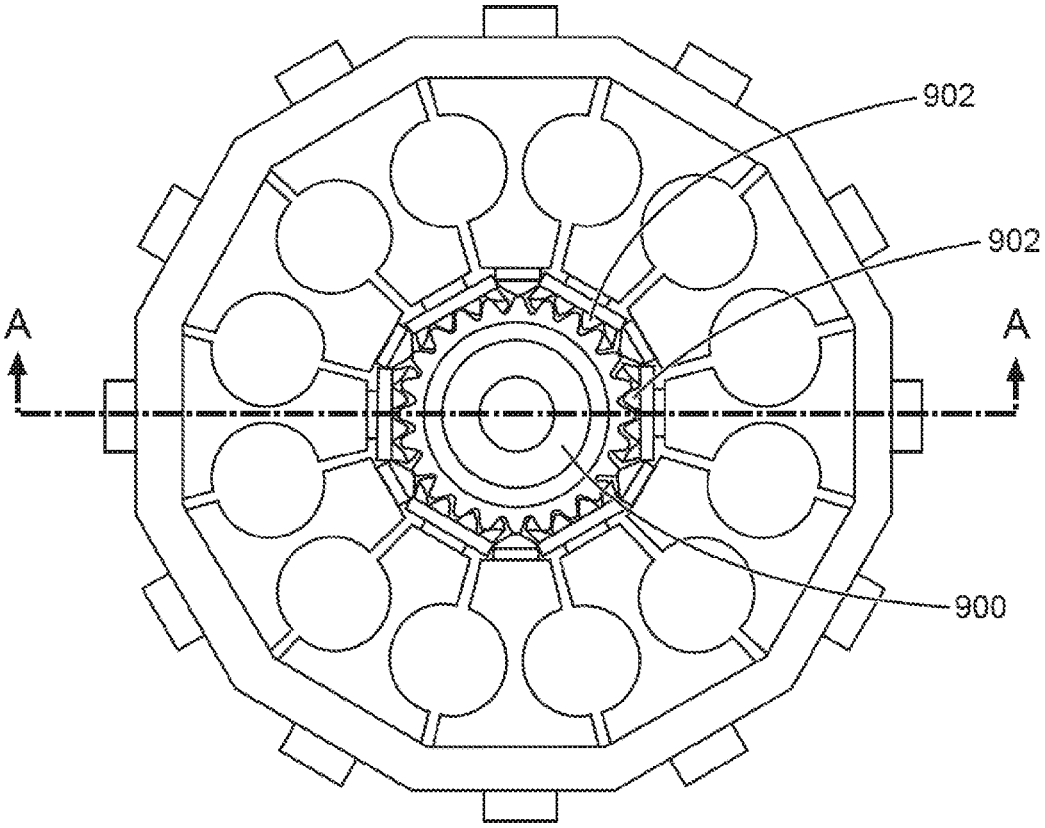

Turning now to the drive mechanism causing rotation of the rollers, the rollers may, in principle, be driven by separate (e.g., electric) motors whose operation is synchronized and/or coordinated by the controller. To minimize the amount of hardware, however, it may be beneficial to, instead, drive all (or at least multiple) of the rollers by the same motor, using mechanical transmission means such as gears and belts (or, alternatively, suitably configured electromagnetic fields generated by electromagnets and/or permanent magnets) to transfer the rotation of the motor onto the various rollers. An example embodiment of a drive mechanism that uses a single motor to drive a set of radially arranged conical rollers is shown in FIGS. 9A and 9B. The drive mechanism includes a single centrally arranged driver bevel gear 900, which is rotated by a motor (not specifically shown) about an axis parallel to the fluid flow, and a plurality of driven bevel gears 902 (one for each of the rollers) that mesh with the driver bevel gear 900. The pitch angles of the driver gear bevel gear 900 and a driven bevel gear 902 may add up to 90° such that the driven bevel gears 902 rotate about axes perpendicular to the axis of rotation of the driver bevel gear 900. The shafts of the driven bevel gears may coincide with or be fixedly attached to the axles of the rollers.

Figure 9C:
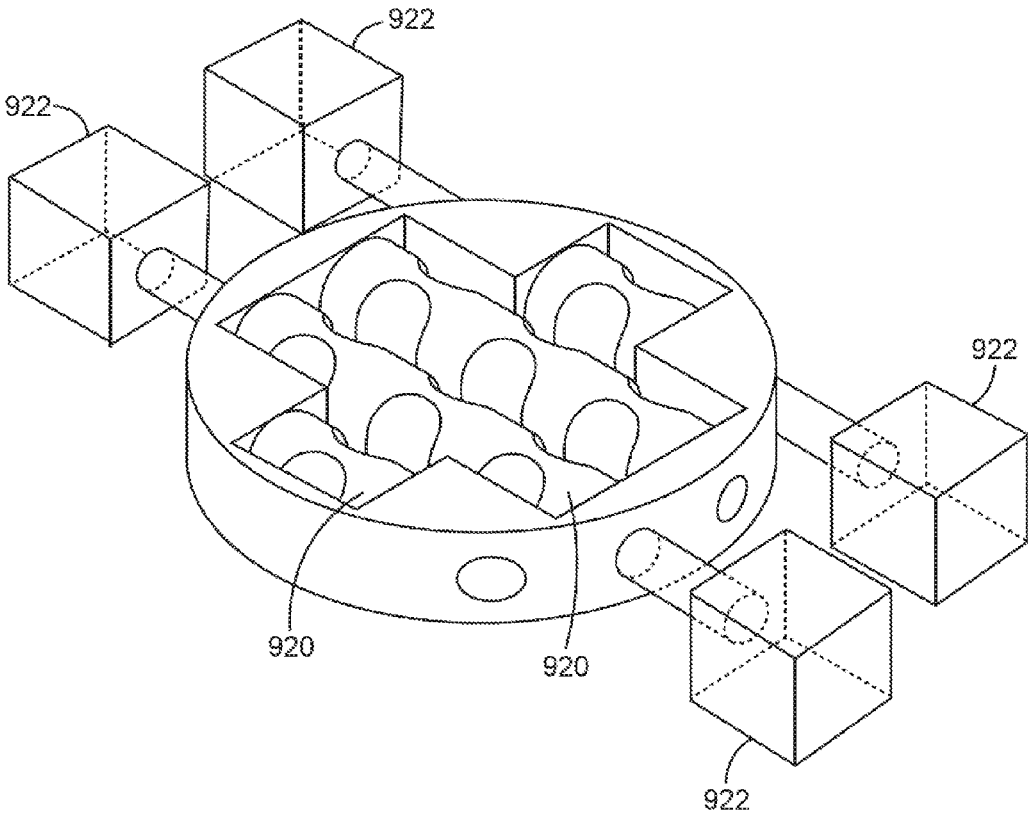
FIG. 9C is a perspective view of an example drive mechanism including separate motors for the individual cylindrical rollers in a parallel arrangement, in accordance with one embodiment.

FIG. 9C conceptually illustrates a drive mechanism for a parallel arrangement of (e.g., cylindrical) rollers. Herein, each roller 920 is separately driven by an associated motor 922. The motors may (but need not) be placed inside the housing, and may be arranged about the valve structure in a manner that efficiently utilizes the available space; for instance, as shown, the motors 922 associated with pairs of adjacent rollers 920 may be placed on opposite sides of the valve structure. In some embodiments, a single motor drives groups of two or more (e.g., adjacent) rollers in unison. For example, the motor may directly cause rotation of one of the rollers' axles, and the rotational motion may be mechanically coupled to the axles of the other rollers within the group via a series of meshing gears. In general, suitable drive mechanisms for the various roller arrangements in accordance herewith can be readily implemented without undue experimentation.

The speed and direction of roller rotation can generally be varied by the motor in accordance with an electrical input signal. In this way, a carrier wave resulting from constant rotation of the rollers can be modulated to encode the data to be telemetered. FIGS. 10A-10C illustrate an example embodiment, in which frequency-shift keying is used. FIG. 10A shows the binary signal containing the data to be telemetered, and FIG. 10B shows the sinusoidal (or quasi-sinusoidal) carrier wave (generated, e.g., as illustrated in FIG. 3). In FIG. 10C, the carrier wave has been modulated to increase the frequency during periods when the binary signal is 1, and decrease the frequency during periods when the binary signal is 0.

Figure 11C:
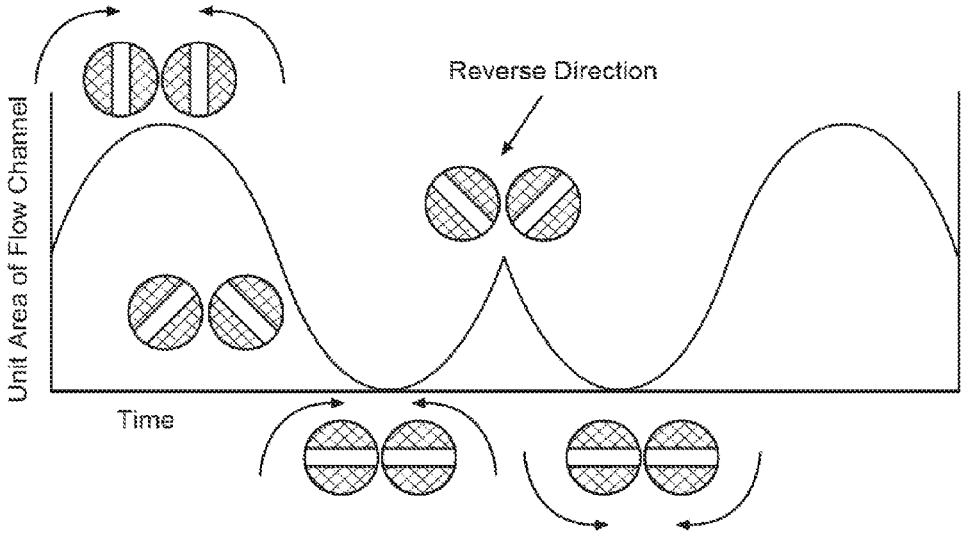
FIGS. 11C and 11D are graphs of the area of the flow channel, created by an example valve structure with two symmetric cut-outs, as a function of the rotational position, showing how the area of the flow channel can be changed to generate a phase change such as used in the modulated signal-encoding wave shown in FIG. 11B.
Figure 11D:
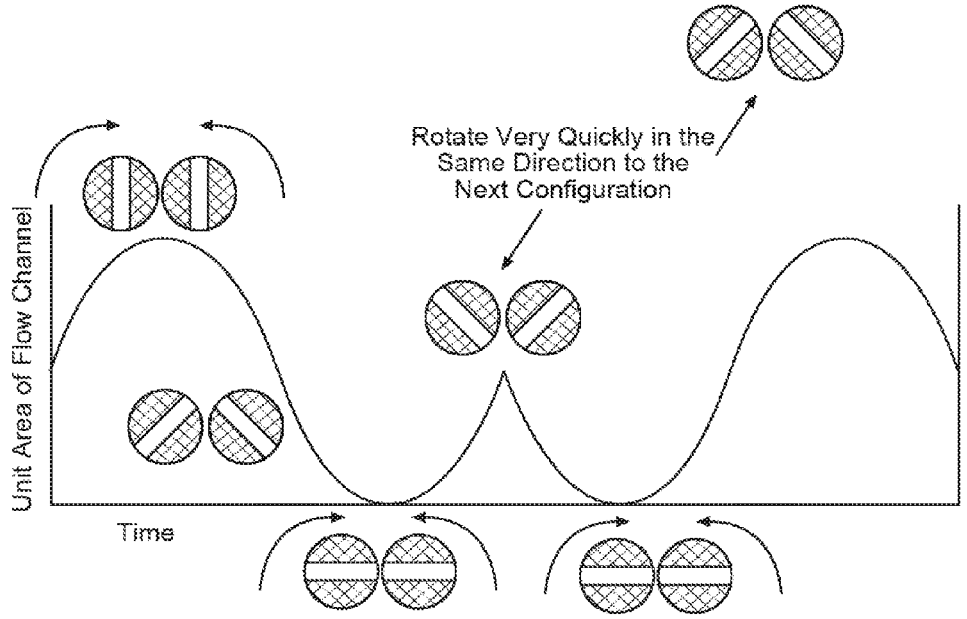

FIGS. 11A and 11B illustrate phase-shift keying in accordance with an alternative embodiment. Here, whenever the binary signal (shown in FIG. 11A) switches between 0 and 1, a 180° phase shift is imparted on the carrier wave. This phase shift can be achieved by reversing the direction of rotation, as illustrated in FIG. 11C, which shows the flow-channel area, along with the rotational position of a pair of rollers each having two symmetric carve outs, as a function of time. Alternatively, a 180° phase shift in the variation of the flow-channel area can be generated by causing a very quick (e.g., as close to instantaneous as possible) 90° rotation of the rollers when the valve is in the half-open state (corresponding to an orientation of the carve-outs at 45° relative to the direction of fluid flow); this embodiment is illustrated in FIG. 11D.

Alternatively to rotating the rollers (or at least one roller) continuously to generate a continuous pressure wave and imparting a signal on that pressure wave by modifying the speed or direction of rotation, the valve structure may be operated in a stepped mode, i.e., the rollers may be moved to discrete rotational positions and paused thereat to create discrete pressure pulses. A discrete pressure pulse may be achieved, for example, by rotating the rollers depicted in FIGS. 2A-2L by 90° to turn the valve from its open to its closed state or vice versa. More generally, in many systems, the rotational positions at which the rollers are halted may be selected such that the corresponding differences in flow-channel areas vary by a selected proportion relative to one or more neighboring positions. As one example, the positions may be selected such that the differences in flow channel areas vary by substantially equal amounts between neighboring positions, resulting in substantially constant pressure-pulse amplitude shifts as the rollers are moved from one position to the next. Alternatively, the rollers may be rotated by angles that result in different pressure-pulse amplitudes (e.g., selected from a pre-defined, finite (and typically small) number of discrete pressure amplitudes—for example, often less than five amplitudes). If the rollers can be rotated independently from each other (e.g., if each roller is driven by a separate motor), it is also possible to vary the pressure-pulse amplitude by varying the number of rollers moved at a given step.

The pressure pulses may be spaced at integer multiples of a specified, fixed time interval, such that a binary signal may be encoded, in its simplest form, via the presence (corresponding to 1) or absence (corresponding to 0) of pulses at the specified intervals within a temporal pulse sequence. In more complex encoding schemes, a set of a few (e.g., three or four) different discrete pressure-pulse amplitudes may be utilized to convey information at a higher rate. Further, in a modified encoding scheme, the time intervals between successive pulses may be varied to encode information, such as the amplitude of an analog signal.

Figure 12:
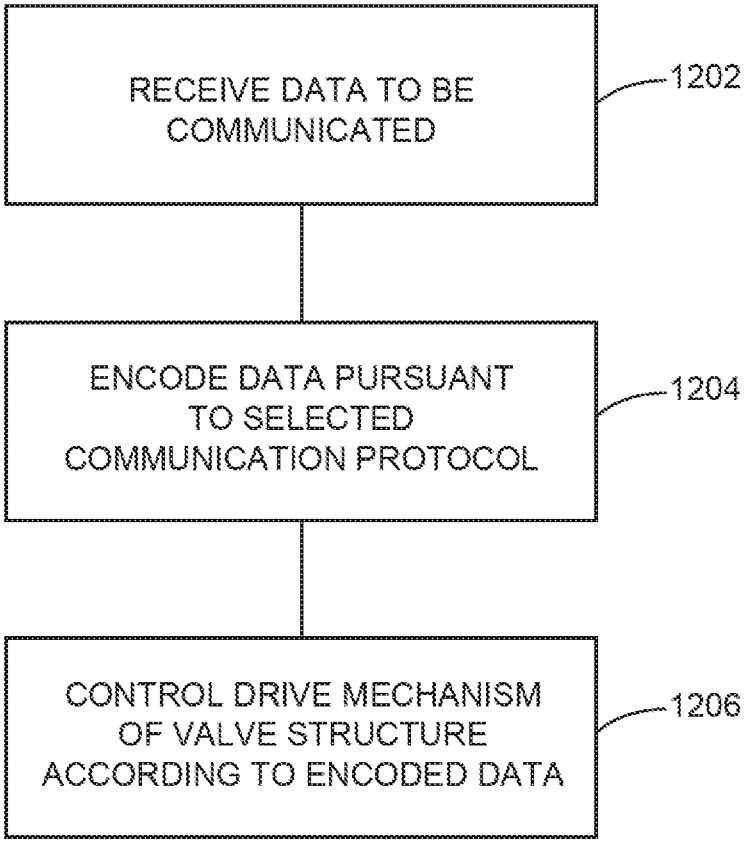
FIG. 12 depicts a flow chart of an example method for using a mud pulse generator in accordance with various embodiments.

Referring now to FIG. 12, a high-level flow chart of an example method 1200 of operating a fluid pulse generator in accordance herewith is depicted. As a first step 1202, the controller 156 receives data to be communicated, e.g., from an MWD/LWD tool or other sensor in the tool string. Next, the data is prepared for communication. This will typically include encoding the data pursuant to a selected communication protocol (1204). Any of a wide variety of communication protocols for communicating data through a pulse series can be implemented, including frequency-shift keying (FSK), phase-shift keying (PSK), amplitude-shift keying (ASK), or time-interval keying in a stepped operational mode (as described above), and combinations of the above, as well as other communication protocols. The controller 156 will then control the drive mechanism 152 of the valve structure 150, as indicated at 1106, e.g., by changing the electrical current input to the motor 153 to vary the rotational speed, direction of rotation, or rotational position of the rollers in accordance with the encoded data.

Various example embodiments are now described:

Example 1: a fluid pulse generator comprising a housing defining a fluid conduit therethrough; and a valve structure disposed within the fluid conduit, the valve structure comprising a plurality of rollers, each roller rotatable around a respective longitudinal axis extending across at least part of a cross-section of the fluid conduit, wherein the rollers collectively occlude at least a portion of a cross-sectional area of the fluid conduit, the occluded portion varying with the rotational positions of the rollers.

Example 2: the fluid pulse generator of example 1, wherein the longitudinal axes are generally perpendicular to the direction of fluid flow at an entrance to the valve structure.

Example 3: the fluid pulse generator of examples 1 or 2, wherein each roller defines a carve-out extending inwardly from a lateral surface of an envelope of the roller.

Example 4: the fluid pulse generator of example 3, wherein at least some of the envelopes are cylindrical.

Example 5: the fluid pulse generator of example 4, wherein at least some of the longitudinal axes are arranged in parallel with each other.

Example 6: the fluid pulse generator of example 3, wherein at least some of the envelopes are conical.

Example 7: the fluid pulse generator of example 6, wherein at least some of the longitudinal axes are arranged along radii of the cross-section of the fluid conduit.

Example 8: the fluid pulse generator of any of examples 1 through 7, wherein the occluded portion of the cross-sectional area varies sinusoidally with the rotational position of at least one roller.

Example 9: the fluid pulse generator of any of examples 1 through 8, further comprising a drive mechanism operably coupled to the plurality of rollers to cause rotation thereof.

Example 10: the fluid pulse generator of example 9, wherein the drive mechanism is configured to rotate the plurality of rollers in the same direction.

Example 11: the fluid pulse generator of example 9, wherein the drive mechanism is configured to rotate the plurality of rollers in alternatingly opposite directions.

Example 12: the fluid pulse generator of example 9, 10 or 11, further comprising a controller configured to operate the drive mechanism to thereby control at least one of a speed of rotation, a direction of rotation, or rotational positions of the plurality of rollers.

Example 13: the fluid pulse generator of any of examples 1 through 12, wherein the controller is configured to continuously rotate at least one of the rollers, and to modulate the speed or direction of rotation based on a signal received by the controller.

Example 14: the fluid pulse generator of any one of examples 1 through 12, wherein the controller is configured to control rotational positions of the plurality of rollers, based on a signal received by the controller, to thereby generate discrete pressure pulses.

Example 15: a method of generating fluid pulses in a fluid column, the method comprising actuating a fluid pulse generator disposed in a tool string within a wellbore (the tool string containing the fluid column, the fluid pulse generator comprising a housing defining a fluid conduit therethrough and a valve structure disposed within the fluid conduit, the valve structure comprising a plurality of rollers, each roller rotatable around a respective longitudinal axis extending across at least part of a cross-section of the fluid conduit, the rollers collectively occluding at least a portion of a cross-sectional area of the fluid conduit, and a drive mechanism operably coupled to the plurality of rollers to cause rotation thereof), wherein actuating the fluid pulse generator comprises receiving information to be communicated through the fluid column, encoding the information in accordance with a selected communication protocol, and controlling the drive mechanism to cause rotation of the rollers in accordance with the encoded information to generate a corresponding series of fluid pulses in the fluid column.

Example 16: the method of example 15, wherein each roller defines a carve-out extending inwardly from a lateral surface of an envelope of the roller.

Example 17: the method of example 15 or 16, wherein controlling the drive mechanism in accordance with the encoded information comprises continuously rotating at least one of the rollers, and varying a rotational speed or a direction of rotation.

Example 18: the method of example 15 or 16, wherein controlling the drive mechanism in accordance with the encoded information comprises controlling rotational positions of the rollers to create discrete pressure pulses.

Example 19: a system comprising a drill string; a drill bit attached to the drill string at a lower end thereof; a measuring tool disposed in the drill string; and a fluid pulse generator disposed in the drill string, the fluid pulse generator comprising a valve structure disposed within a fluid conduit defined through the drill string, the valve structure comprising a plurality of rollers, each roller rotatable around a respective longitudinal axis extending across at least part of a cross-section of the fluid conduit, wherein the rollers collectively occlude at least a portion of a cross-sectional area of the fluid conduit, the occluded portion varying with the rotational positions of the rollers, the fluid pulse generator further comprising a drive mechanism operably coupled to the plurality of rollers to cause rotation thereof and a controller communicatively coupled to the drive mechanism and the measuring tool to control the drive mechanism based on a signal received from the measuring tool.

Example 20: the system of example 19, wherein the controller is configured to receive, from the measuring tool, information to be communicated through a fluid column in the tool string, encode the information in accordance with a selected communication protocol, and control the drive mechanism to cause rotation of the rollers in accordance with the encoded information to generate a corresponding series of fluid pulses in the fluid column.

Many variations may be made in the structures and techniques described and illustrated herein without departing from the scope of the inventive subject matter. Accordingly, the scope of the inventive subject matter is to be determined by the scope of the following claims and all additional claims supported by the present disclosure, and all equivalents of such claims.

What is claimed is:

1. A fluid pulse generator, comprising:

a housing defining a fluid conduit therethrough;

a valve structure disposed within the fluid conduit, the valve structure comprising a plurality of rollers, each roller rotatable around a respective longitudinal axis extending across at least part of a cross-section of the fluid conduit, wherein the longitudinal axes are at an angle of 90 degrees+/−45 degrees relative to a direction of fluid flow at an entrance to the valve structure, and wherein the rollers collectively occlude at least a portion of a cross-sectional area of the fluid conduit, the occluded portion varying with rotational positions of the rollers.

2. The fluid pulse generator of claim 1, wherein the longitudinal axes are at an angle of 90 degrees+/−30 degrees relative to the direction of fluid flow at an entrance to the valve structure.

3. The fluid pulse generator of claim 1, wherein each roller defines a carve-out extending inwardly from a lateral surface of an envelope of the roller.

4. The fluid pulse generator of claim 3, wherein at least some of the envelopes are cylindrical.

5. The fluid pulse generator of claim 4, wherein at least some of the longitudinal axes are arranged in parallel with each other.

6. The fluid pulse generator of claim 3, wherein at least some of the envelopes are conical.

7. The fluid pulse generator of claim 6, wherein at least some of the longitudinal axes are arranged along radii of the cross-section of the fluid conduit.

8. The fluid pulse generator of claim 1, wherein the occluded portion of the cross-sectional area varies sinusoidally with a rotational position of at least one roller.

9. The fluid pulse generator of claim 1, further comprising a drive mechanism operably coupled to the plurality of rollers to cause rotation thereof.

10. The fluid pulse generator of claim 9, wherein the drive mechanism is configured to rotate the plurality of rollers in the same direction.

11. The fluid pulse generator of claim 9, wherein the drive mechanism is configured to rotate the plurality of rollers in alternatingly opposite directions.

12. The fluid pulse generator of claim 9, further comprising a controller configured to operate the drive mechanism to thereby control at least one of a speed of rotation, a direction of rotation, or rotational positions of the plurality of rollers.

13. The fluid pulse generator of claim 12, wherein the controller is configured to continuously rotate at least one of the rollers, and to modulate the speed or direction of rotation based on a signal received by the controller.

14. The fluid pulse generator of claim 12, wherein the controller is configured to control rotational positions of the plurality of rollers, based on a signal received by the controller, to thereby generate discrete pressure pulses.

15. A method of generating fluid pulses in a fluid column, the method comprising:

actuating a fluid pulse generator disposed in a tool string within a wellbore, the tool string containing the fluid column, the fluid pulse generator comprising, a housing defining a fluid conduit therethrough and a valve structure disposed within the fluid conduit, the valve structure comprising a plurality of rollers, each roller rotatable around a respective longitudinal axis extending across at least part of a cross-section of the fluid conduit, wherein the longitudinal axes are at an angle of 90 degrees+/−45 degrees relative to a direction of fluid flow at an entrance to the valve structure, the rollers collectively occluding at least a portion of a cross-sectional area of the fluid conduit, and a drive mechanism operably coupled to the plurality of rollers to cause rotation thereof, wherein actuating the fluid pulse generator comprises receiving information to be communicated through the fluid column, encoding the information in accordance with a selected communication protocol, and controlling the drive mechanism to cause rotation of the rollers in accordance with the encoded information to generate a corresponding series of fluid pulses in the fluid column.

16. The method of claim 15, wherein each roller defines a carve-out extending inwardly from a lateral surface of an envelope of the roller.

17. The method of claim 15, wherein controlling the drive mechanism in accordance with the encoded information comprises continuously rotating at leas one of the rollers, and varying a rotational speed or a direction of rotation.

18. The method of claim 15, wherein controlling the drive mechanism in accordance with the encoded information comprises controlling rotational positions of the rollers to create discrete pressure pulses.

19. A system comprising:

a drill string;

a drill bit attached to the drill string at a lower end thereof;

a measuring tool disposed in the drill string; and a fluid pulse generator disposed in the drill string, the fluid pulse generator comprising:

a valve structure disposed within a fluid conduit defined through the drill string, the valve structure comprising a plurality of rollers, each roller rotatable around a respective longitudinal axis extending across at least part of a cross-section of the fluid conduit, wherein the longitudinal axes are at an angle of 90 degrees+/−45 degrees relative to a direction of fluid flow at an entrance to the valve structure, and wherein the rollers collectively occlude at least a portion of a cross-sectional area of the fluid conduit, the occluded portion varying with rotational positions of the rollers, a drive mechanism operably coupled to the plurality of rollers to cause rotation thereof, and a controller communicatively coupled to the drive mechanism and the measuring tool to control the drive mechanism based on a signal received from the measuring tool.

20. The system of claim 19, wherein the controller is configured to receive, from the measuring tool, information to be communicated through a fluid column in the tool string, encode the information in accordance with a selected communication protocol, and control the drive mechanism to cause rotation of the rollers in accordance with the encoded information to generate a corresponding series of fluid pulses in the fluid column.

* * * * *